United States Patent [19]

Drakes

[11] 3,941,226

[45] Mar. 2, 1976

[54] ELECTRONIC COIN SWITCH

[75] Inventor: Russell J. Drakes, Buffallo, N.Y.

[73] Assignee: The Wurlitzer Company, Chicago, Ill.

[22] Filed: Mar. 22, 1974

[21] Appl. No.: 453,686

[52] U.S. Cl. ..... 194/1 R; 194/1 K; 193/DIG. 1; 250/223 R

[51] Int. Cl.[2] ..... G07F 1/04

[58] Field of Search ..... 250/222 PC, 222 R, 223, 250/221; 307/311, 315; 194/1 R, 1 E, 1 K, 1 M, 1 N; 193/DIG. 1

[56] References Cited

UNITED STATES PATENTS

| | | | |
|---|---|---|---|
| 2,088,154 | 7/1937 | Johns | 194/1 K |
| 2,228,780 | 1/1941 | Roberts | 250/221 |
| 2,237,132 | 4/1941 | Christensen | 250/223 R X |
| 2,247,488 | 7/1941 | Gottfried et al. | 194/100 R |
| 3,412,293 | 11/1968 | Maupin | 307/315 X |
| 3,745,354 | 7/1973 | Vargo | 250/223 R X |
| 3,806,651 | 4/1974 | Battrick | 194/1 N X |

*Primary Examiner*—Robert B. Reeves
*Assistant Examiner*—Joseph S. Rolla
*Attorney, Agent, or Firm*—Olson, Trexler, Wolters, Bushnell & Fosse, Ltd.

[57] ABSTRACT

A coin switch for coin operated vending machines, especially juke boxes, in which a coin, after it has been successfully passed by a slug rejector, drops through a chute according to its denomination and interrupts a light beam falling on a photo-sensitive device, specifically a photo transistor. Different chutes or passageways are provided for coins of different denomination, and the chutes are so configured as to limit the speed of passage of a coin whereby to insure production of a modulated signal of recognized character of usable width. Such signal is conveniently a D.C. pulse.

7 Claims, 15 Drawing Figures

ELECTRONIC COIN SWITCH

BACKGROUND OF THE INVENTION

For many years coin operated vending machines, and especially juke boxes, have used electro-mechanical coin switches. After a coin or coins have passed through a slug rejector the coins go into a multiple slot or multiple chute coin detecting device having a mechanical coin detector adjacent each slot or chute. Engagement of the mechanical detector by a coin causes closure of mechanical switches. Such coin switches have evidenced various degrees of difficulty over the years. The contacts become pitted and burned, and also dirty. Switches thus may operate falsely, or fail to operate at all. Cleaning by a service man from time to time is essential, and adjustment of the physical position of the detector also is necessary from time to time due to the fact that constant physical agitation thereof by dropping coins causes bending, misalignment, etc.

A further problem has become more pronounced in recent years with the move toward digital electronic operation of coin operated devices. Mechanical contacts tend to bounce. Such bouncing will produce a series of pulses, rather than a single pulse, and may result in false crediting. This problem is particularly irksome when contacts are burned or dirty.

OBJECT AND SUMMARY OF THE PRESENT INVENTION

Broadly speaking, the object of the present invention is to provide an improved electronic coin switch having no moving parts.

More specifically, it is an object of the present invention to provide an electronic coin switch utilizing a photo sensitive device, specifically a photo transistor.

It is further an object of the present invention to provide an electronic coin switch requiring little or no servicing throughout its life.

A further object of the present invention is to provide an electronic coin switch having means for insuring provision of a modulated signal of recognized character of usable width.

Yet another object of the invention is to provide an electronic coin switch having shaped coin chutes to gain space between exit slots to provide space for light sources and sensors in a small package.

The foregoing and other objects of the present invention are attained by a structure in which coins of four different denominations respectively pass four light beams to change the condition of the light beam inpinging on a respective photo transistor, either breaking the light beam or establishing a desired light beam by reflection. Additional slots or chutes can be provided for accommodating one or more coins of additional denominations. Since two commonly available slug rejectors have somewhat different exit paths, the present coin switch is provided with input slots to accommodate to either of such two slug rejectors. The internal slots or chutes are configured to bring coins out to four predetermined exits irrespective of which slug rejector is used. Photo transistors are used to insure adequate sensitivity without requiring excessive gain which would cause additional expense and might cause noise problems.

In a preferred form of the invention an incandescent lamp bulb is used as a light source and is positioned between two coin chutes so that the small light source is used for the two chutes. Derating of an incandescent bulb can result in extended service life commensurate with the service life of the vending machine. However, it is contemplated that other light sources could be used, and for instance light emitting diodes could be used for each chute, and such devices are known to have substantially infinite service life. However, light emitting diodes are directional in nature, and it is probable that a light emitting diode would be required for each chute or coin path, without sharing of the light source, as is possible with an incandescent or other more or less conventional lamp bulb.

The coin chutes or slots are provided in a plastic body or housing having a printed circuit board affixed thereto with all electronic components preassembled on the printed circuit board. Specifically, the light sources and light detectors are mounted on this board for ready preassembly, and for ready access in the event that servicing should be necessary.

DETAILED DESCRIPTION OF THE INVENTION

Figure 1:
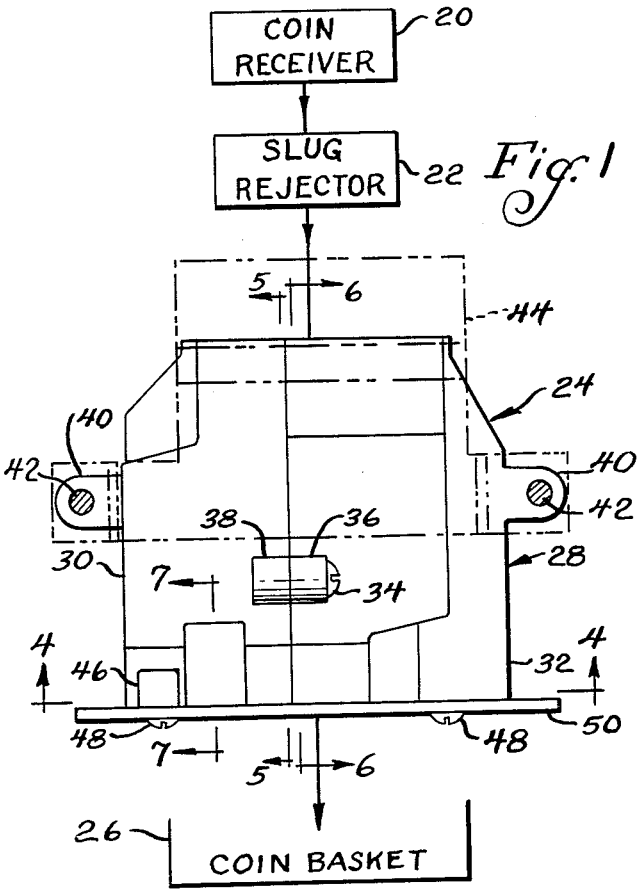
FIG. 1 provides a side view of my improved coin switch with related parts shown in block diagram.
Figure 7:
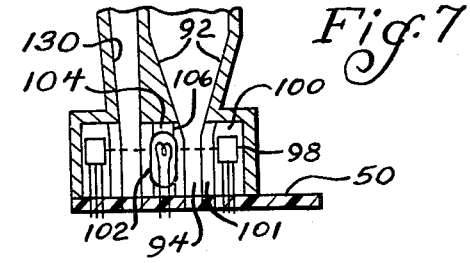
FIG. 7 is a fragmentary-sectional view taken substantially along the line 7—7 in FIG. 1.
Figure 2:
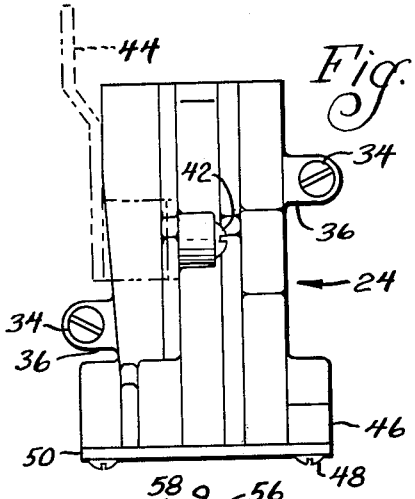
FIG. 2 comprises an end view taken at right angles to FIG. 1.
Figure 3:
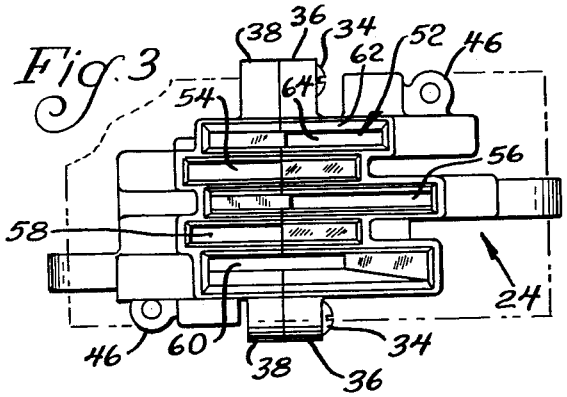
FIG. 3 is a top view of the improved coin switch.
Figure 5:
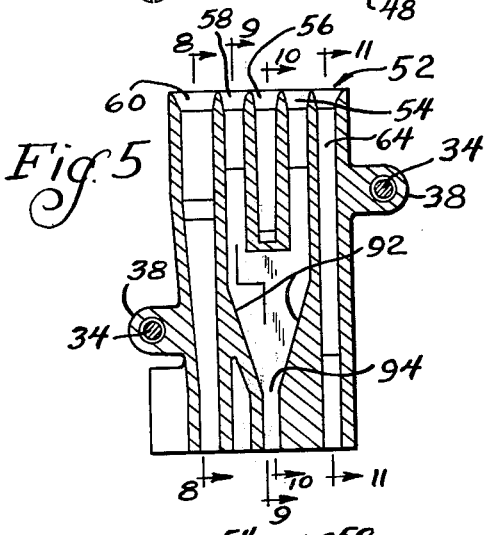
FIG. 5 is a cross-sectional view taken substantially along the line 5—5 in FIG. 1.

Turning now to the drawings in greater detail, and first to FIGS. 1–3, a coin receiver 20 of conventional construction is shown schematically by block diagram. The coin or coins as first inserted in the coin drop of the vending machine, for example a juke box, are received by the coin receiver 20, and then passed on to a slug rejector 22 of conventional construction from whence they pass to the coin switch 24 of the present invention. After traversing the coin switch 24 the coins drop into a coin basket 26 which may be of conventional construction, and which therefore is likewise shown in schematic fashion.

The coin switch 24 includes a plastic molded housing 28 which is preferably molded in two parts 30 and 32 secured together by screws 34 extending through ears 36 and threading into complementary ears 38. The two housing portions additionally are provided with ears 40 at the opposite extremities for receipt of screws 42 to mount the coin switch on a bracket 44 shown in broken lines in order to properly mount the coin switch within the juke box or other vending machine. In addition to the foregoing, important exterior aspects of the housing include protuberances 46 for receipt of screws 48 passed through a printed circuit board 50 to secure the printed circuit board on the underside of the housing 28. All of the electrical components of the present invention are preassembled on the printed circuit board 50 and coact with the physical structure of the housing as will hereinafter be set forth in greater detail.

The housing 28 is provided with five inlet slots to accept coins of four different denominations. The reason for five slots for four denominations is that two different commonly available commercial slug rejectors have different coin exit patterns. The exit patterns are identical for a 5-cent piece, a 25-cent piece, and a 50-cent piece, but they are quite different as to the dime or 10-cent piece. The present housing and switch are made to connect to either of these two commonly available slug rejectors. Thus, referring for the moment only to FIG. 3, there is a 5-cent inlet slot 52 adjacent one side wall of the housing. Immediately adjacent it is an inlet slot 54 for receipt of a 10-cent piece from a first commercial slug rejector. Adjacent to this and at the middle of the housing there is a coin acceptance slot 56 for 25-cent pieces. Beyond this is a second 10-cent coin slot 58 for receipt of dimes from the second commonly available slug rejector. It will be observed that the 10-cent slots 54 and 58 are symmetric about the 25-cent slot 56 which lies substantially along the center line. Finally, at the opposite extreme from and substantially symmetric relative to the 5-cent slot 52 there is a 50-cent slot 60. The housing could be extended if desired to provide for acceptance of a so-called silver dollar.

Reference now should be had more particularly to FIGS. 3–6 and 11 wherein the coin slot 52 for receipt of a 5-cent piece will be seen to have a tapered or beveled entry 62 leading into a chute 64 having a thickness great enough to accept and pass a nickel or 5-cent piece or the thickest foreign coin that might traverse the slot. The width (the transverse dimension in FIG. 11) is greater than the diameter of a nickel or the largest diameter foreign coin that might traverse the slot. The chute 64 is provided with a diagonal outward offset 66 at more or less its vertical midsection, and further is provided with a sharper diagonal inward offset 68 approximately 25 percent the way from the bottom to the top of the chute. The vertical sight through the chute, i.e. between upper wall 70 and lower wall 72, is less than the diameter of a nickel. Accordingly, a nickel received from the slug rejector 22 in the slot 52 cannot cover the chute or passage 64 in a straight drop, whereby the speed of the nickel is limited as it passes through the exit slot 74 in the printed circuit board 50.

A photo transistor 76 (see also FIGS. 13 and 14) is mounted on the printed circuit board 50 outward of the slot 74 and immediately adjacent thereto. The photo transistor 76 is received in a cavity 78 in the housing 28 and communicates through a vertical slot 80 with the coin chute 64.

Directly opposite the photo transistor 76 there is a light source 82 mounted on the printed circuit board 50 and received in a cavity 84 in the housing 28. A vertical slot 86 provides a communication between the cavity 84 and the coin chute 64. Thus, light from the lamp 82 extends across the coin chute 64 for receipt by the photo transistor 76. When a nickel drops through the chute the light beam is interrupted, and the offset in the chute insures slow enough travel of the light beam for production of a pulse of useful length from the photo transistor.

For economic reasons the light source or lamp 82 in the illustrated embodiment comprises an incandescent lamp derated to operate at a lower voltage than its nominal rated voltage. With such derating the bulb will have a service life equal to or greater than the expected service life of the juke box or other vending machine. Other types of light sources could be used, for example a light emitting diode. However, a light emitting diode is directional, and as will be apparent hereinafter the illumination from the lamp 82 is shared. Hence, either two light emitting diodes or a reflecting surface of some sort would be necessary.

Figure 9:
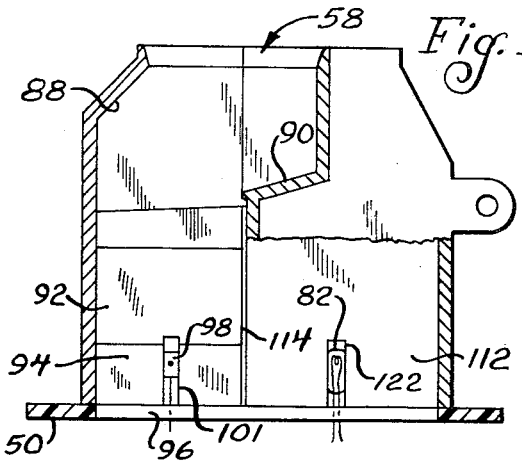
FIG. 9 is a longitudinal-sectional view taken substantially along the line 9—9 in FIG. 5.

The two dime slots 54 and 58 are similar to the nickel 52, and are substantially mirror images of one another. Hence, a longitudinal section of only one of the dime slots, namely slot 58, is shown in FIG. 9. The dime slots are best seen with reference to the aforesaid FIG. 9 and FIG. 5, each being provided with a beveled entering or receiving end similar to that of the nickel slot. The thickness of each dime slot, and also the width thereof are determined by criteria similar to those for the 5-cent slot. An upper offset 88 extends diagonally out from the receiving end of the slot, while a sharper inward offset 90 is provided approximately a third of the way down. Shortly below the inward offset 90 each of the dime slots 54 and 58 is offset inwardly at 92 to converge to a single coin chute 94 through which the dime exits from the housing through a long slot 96 in the printed circuit board 50. Thus, no matter which of the slots 54, 58 receives a dime, the dime always exits through the common dime chute 94.

A photo transistor 98 is mounted on the printed circuit board 50 and is received in the cavity 100 in the housing 28, the cavity 100 communicating through a slot 101 with the common dime coin chute 94. A light source 102 similar to the light source 82 is mounted on the printed circuit board 50 and is received in a cavity 104 in the housing communicating through a slot 106 with the dime coin chute 94, directly opposite the slot 101 leading to the photo transistor 98. Thus, the photo transistor is normally always illuminated by the light source 102, but is darkened by the passage of a dime. The offset 90 slows the dime in its drop as does the converging wall 92, whereby the dime passes the path between the light source and the photo transistor at a limited speed, whereby to insure an output modulated signal of recognized character, conveniently a D.C. pulse of useful length.

Figure 6:
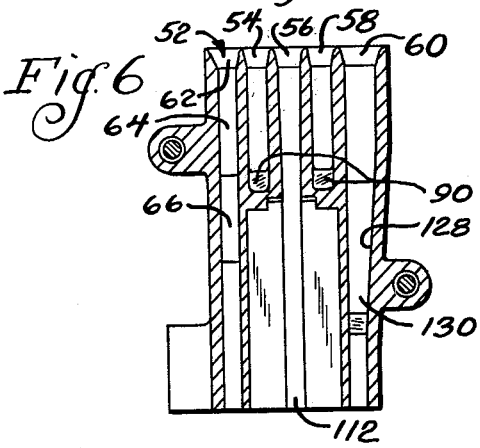
FIG. 6 is a cross-sectional view taken substantially along the line 6—6 in FIG. 1.
Figure 4:
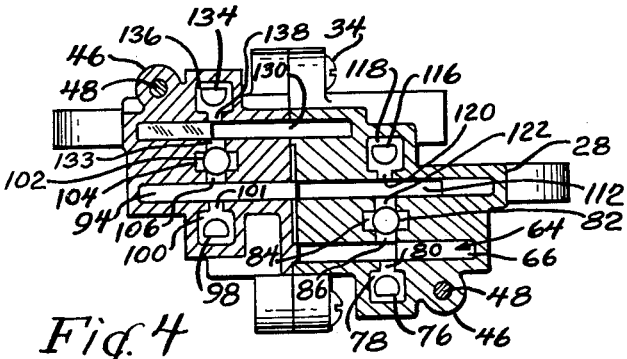
FIG. 4 is a cross-sectional view taken substantially along the line 4—4 in FIG. 1.
Figure 8:
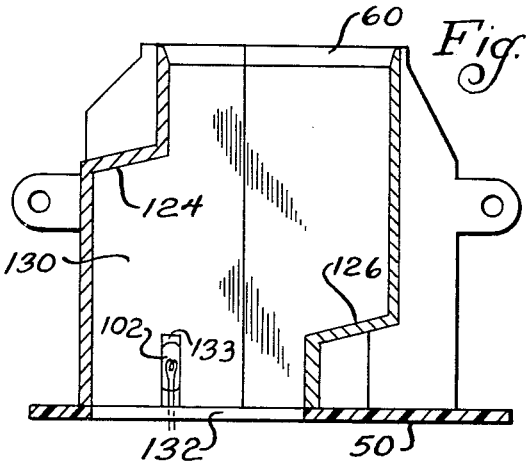
FIG. 8 is a longitudinal-sectional view taken substantially along the line 8—8 in FIG. 5.
Figure 10:
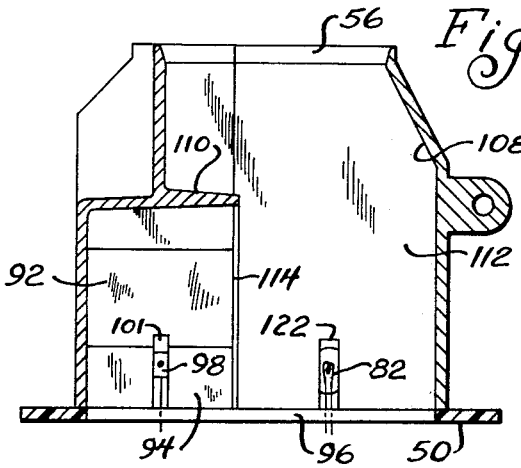
FIG. 10 is a longitudinal-sectional view taken substantially along the line 10—10 in FIG. 5.
Figure 11:
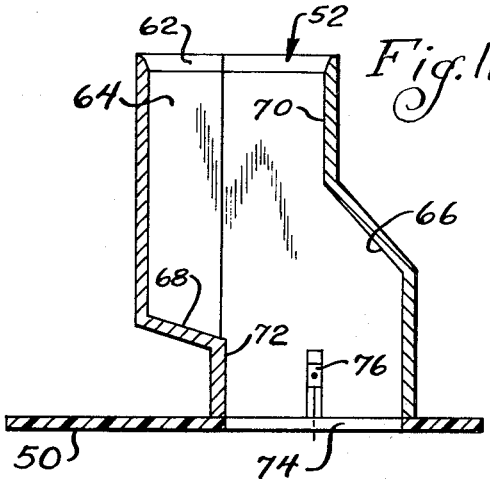
FIG. 11 is a longitudinal-sectional view taken substantially along the line 11—11 in FIG. 5.

The 25-cent or quarter slot 56 is best seen in FIG. 6 taken along with FIGS. 9 and 10. The 25-cent slot has a beveled receiving end as the previous slots. Immediately below the receiving end the slot 56 is provided with a shallow diagonal offset 108, and below this the slot is provided with a steep, nearly right angle inward offset 110 overlying the conversions of the dimes slots 54 and 58 to the single coin chute 94. The width and thickness of the entrance to the 25-cent slot 56 are again determined by similar criteria. Below the inward offset 110 is a straight drop through a quarter coin chute 112 and out through the previously identified slot 96 in the printed circuit board 50. A vertical transverse wall 114, seen in FIGS. 9 and 10, provides a partition between the dimes chute 94 and the quarter chute 112.

A photo transistor 116 upstands from the printed circuit board 50 directly across the slot 96 from the light source 82, being received in a cavity 118 in the housing 28 and communicating through a slot 120 with the quarter coin chute 112. The light source 82 communicates through a slot 122 with the quarter coin chute 112, whereby the photo transistor 116 is normally illuminated. The offset 110 slows a quarter in its drop, and the fact that this offset is a substantial distance above the light path that is broken by the quarter is a relatively little consequence since the quarter is of substantially greater diameter than are other coins, such as the nickel and the dime heretofore mentioned.

The half dollar slot 60 width is determined by expected coin size, as before, but the thickness is greater than previous coin slots as readily may be seen at the top of FIG. 6. The reason for this is that the two slug rejectors mentioned heretofore have half dollar exits that are slightly offset from one another in the direction of coin axis. Like the other coin slots, the receiving end of this slot 60 is beveled to facilitate entry of a coin. The slot 60 is provided near the top thereof with an outward oblique offset 124, and relatively near the bottom thereof with an inward oblique offset 126, the thickness of the slot tapering at 128 to form a coin chute 130.

The exit slot 132 in the printed circuit board 50 is adjacent the light source 102, and a vertical slot 133 provided communication from the light source to the 50-cent coin chute 130. A photo transistor 134 is mounted on the printed circuit board, being received in a cavity 136 in the housing 28, a slot 138 providing communication with the 50-cent coin chute 130. Thus, light from the light source 102 normally impinges on the photo transistor 134, the light being cut off by the dropping of a 50-cent coin.

Reference has been made throughout to coins of U.S. denomination. It is contemplated that the same coin switch could operate with coins of denomination of other countries. In some instances coins are of sufficiently close size to require no modification. In some cases transverse pins are provided in the housing to reduce the width of a coin chute immediately above the respective light and sensor. It is also contemplated that a slotted mask might be provided above the printed circuit board with slots in the mask of the proper size to center coins of the country in question.

Figure 12:
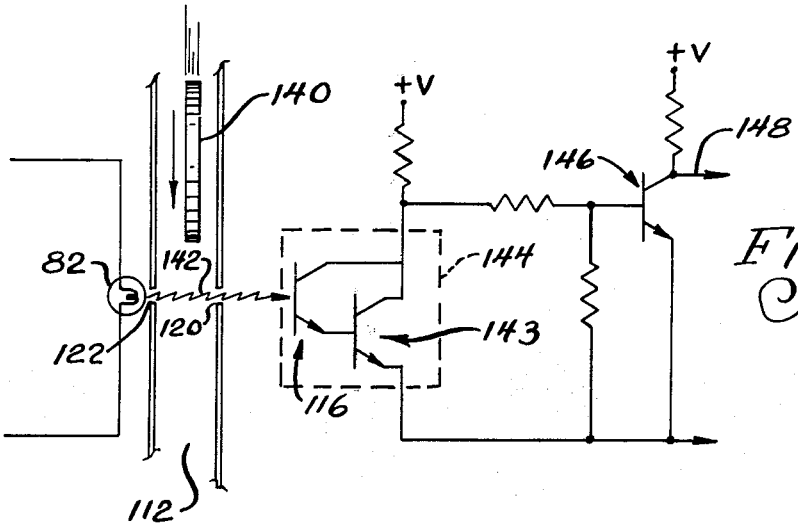
FIG. 12 is an electronic wiring diagram of the invention.

The electrical aspects of the invention are shown schematically in FIG. 12. A coin 140, for example a quarter or 25-cent piece, is shown dropping through the corresponding 25-cent coin chute 112 in a position where it is about to break the light beam 142 from the source of illumination 82 to the photo transistor 116. The photo transistor is shown connected to a second transistor 142 in a darlington pair, this combination being available as a commercial entity and hence indicated by the broken line base 144. As is known, the darlington pair gives much greater sensitivity with little or no increase in noise.

The darlington pair is conventionally biased and is connected to a subsequent phase inverting transistor 146 to an output at 148 leading to the input of the crediting unit of a juke box or other coin operated vending machine.

As has been indicated the coin path in each instance is not a straight through path, having a transverse offset, and in some instances having also a lateral offset. This provides spacing of the chute exits to allow sufficient room for the various lights and sensors while retaining a small housing. A further benefit is that the offsets, coupled with a certain amount of friction between a falling coin and the walls of the corresponding coin chute, act to limit the speed of the coin as it breaks the light beam. As long as the light beam 142 falls on the base of the photo transistor 116 the photo transistor is held on. However, as soon as the light beam is interrupted the photo transistor turns off, and remains off until the light beam is again re-established upon completion of the passage of the coin. Accordingly an output modulated signal, conveniently a D.C. pulse is produced by the circuit of FIG. 12, which signal is long enough by virtue of limitation of the speed of the falling coin that no additional signal producing circuit, such for example as a Schmidt trigger, is required. It will now also be understood that the voltages used in the circuit of FIG. 12 are directly compatible with the voltages of a digital crediting circuit, thereby avoiding the necessity of an interface. A specific money crediting system with which the circuit of FIG. 12 is useful is disclosed in U.S. Pat. No. 3,815,720 issued June 11, 1974 to William V. Mechanian and Robert W. Wheelwright.

Figure 13:
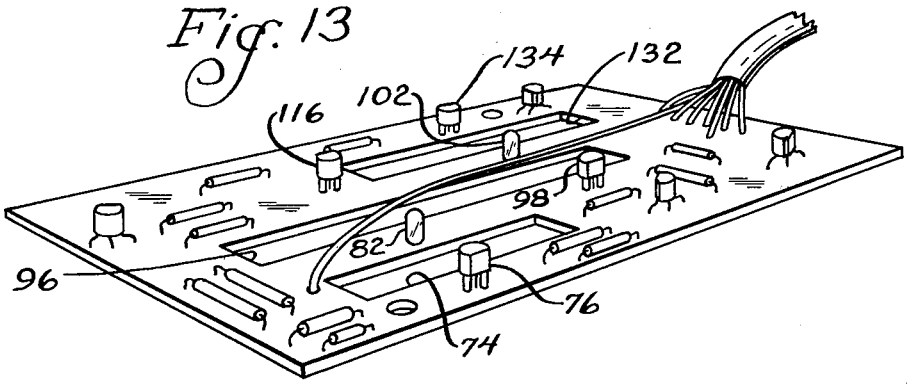
FIG. 13 is a perspective view of the printed circuit board and components thereon.
Figure 14:
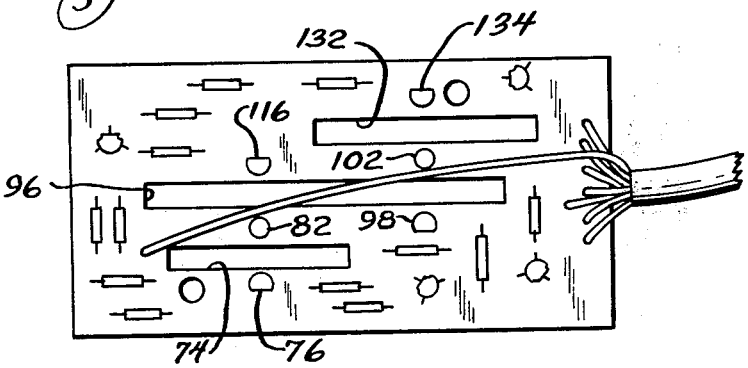
FIG. 14 is a top view of the printed circuit board and components thereon.

The location of the various light sources and photo transistors has been indicated in FIGS. 13 and 14 as well as in certain other of the figures. Additional components of the electronic circuit, bearing in mind that there actually are four of each electronic component shown in FIG. 12 for the four coin denominations, are likewise mounted on the top of the printed circuit board. The specific location of various components is not critical to the present invention, but it will be noted that all such components are mounted exteriorly of the switch housing, whereby to minimize the housing size and to insure proper ventilation and long and trouble-free life of the electrical components.

In the illustrated embodiment of the invention as heretofore shown and described a small incandescent bulb is used for each of the light sources. Other types of light sources could be used, for example a light emitting diode, as mentioned heretofore. Also, in the illustrated embodiment the light beam in each instance is perpendicular to the face of the respective coin. This has an advantage of placing each light sensor in close proximity to the respective light source. It also insures a complete shutting off of the light beam without difficulty. It is contemplated that the light beam could be parallel to the coin face. This allows some conservation of space in placement of the light sources and sensors, but it presents additional problems in avoiding reflections around a coin, particularly a dime, and the signal produced is not as reliable. Space is conserved in the illustrative embodiment of the invention by the chute offsets. Such offsets produce steps for retarding the fall of a coin, whereby a coin moves past the sensor sufficiently slowly that a good usable signal is produced without the necessity and expense of an electronic delay of some sort.

Figure 15:
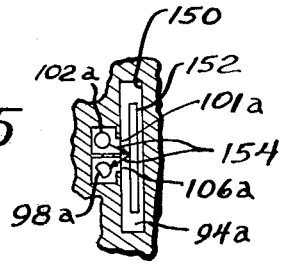
FIG. 15 is a fragmentary-sectional view showing a modified form of the invention utilizing light reflected from the surface of a coin.

It is further within the contemplation of the present invention that light could be reflected from the face of a coin to a light sensor. Such a modification of the invention is shown in FIG. 15 wherein similar numerals with the addition of the suffix *a* are used to identify like parts. The dimes chutes 94*a* is shown as exemplary, the wall opposite the light source 102*a* and sensor 98*a* having a non-reflecting coating 150. The slots 101*a* and 106*a* through which the light source and sensor respectively communicate with the coin chute are offset toward one another so that the relatively reflective surface of a dime 152 establishes a reflected light path 154 from the light source to the dime and back to the sensor when a dime 152 drops past the light source and sensor. This is opposite of the situation previously described and the necessary change in electronics to provide a suitable D.C. pulse or other modulated signal of recognized character will be obvious to anyone skilled in the electronics arts.

Further, a single light could produce a light beam, which, in a given direction would traverse two or more chutes, and a particular coin would be detected by how many sensors it cut off. Additionally, a single coin chute could pass all coins and one or more light beams cut depending on coin size.

A conventional photo electric cell is not satisfactory for use in the present invention. It has high impedance and high voltage, and an interface is thus required to convert to digital voltages. Light sensitive diodes at the present stage of development are not sufficiently sensitive to be practical. Thus, although the invention is not limited in its broadest aspects to a photo transistor, this is the preferred sensor in the present state of the art.

The electronic switch as heretofore disclosed provides a clean pulse or other signal, and not one replete with noise signals as from contact bounce, etc. Furthermore, the switch is completely insensitive to shock or vibration of the system. Foreign substances such as various types of liquids that might be spilled down a coin slot accidentally or on purpose will not cause short circuiting and false crediting.

In the following claims where the word "light" is used it will be understood as including non-visible as well as visible light, and other equivalent forms of radiant energy with corresponding sources and sensors.

The specific embodiment of the invention as herein shown and described is for illustrative purposes. Various changes in structure will no doubt occur to those skilled in the art and will be understood as forming a part of the present invention insofar as they fall within the spirit and scope of the appended claims.

The invention is claimed as follows:

1. An electronic coin switch for use as in a vending machine comprising a housing having a plurality of coin chutes therein, step means in each of said coin chutes for retarding the fall of a coin therethrough to a controlled rate, means providing a plurality of light paths across said chutes, means providing a plurality of cavities in said housing respectively adjacent said chutes to receive light sources to establish said light paths, means providing an additional plurality of cavities in said housing to receive a plurality of light sensors respectively positioned along said light paths on the opposite sides of said chutes and receiving light from a respective light source, a printed circuit board, means mounting said printed circuit board on said housing adjacent the exit ends of the chutes, said printed circuit board having slots therein respectively aligned with said chutes, a plurality of light sources and light sensors preassembled on said printed board and received in the respective cavities, and a plurality of additional electrical components preassembled on said printed circuit board and mounted exteriorly of said housing.

2. A coin switch as set forth in claim 1 wherein each of said sensors comprises a photo transistor.

3. A coin switch as set forth in claim 2 wherein there are one half as many light sources as sensors, each light source comprising a derated incandescent bulb with the light therefrom traversing two light paths.

4. A coin switch as set forth in claim 1 wherein each light source and a respective sensor are on opposite sides of a chute and the respective light path is interrupted by a falling coin.

5. A coin switch as set forth in claim 1 wherein each light source and a respective sensor are on the same side of a chute and the respective light path is completed by reflection from the surface of a falling coin.

6. An electronic coin switch as for use in a vending machine comprising a housing, means in said housing providing a coin chute, means in said housing providing a light path to said coin chute, means in said housing for receiving a source of light on one side of said chute to emit light along said light path, means in said housing for receiving a light sensor positioned along said path for receiving light from said source, a printed circuit board, means for securing said printed circuit board and said housing together, a plurality of electronic components preassembled on said printed circuit board and including a light source and a light sensor, said light source and said sensor respectively being positioned in said housing light source receiving means and said housing sensor receiving means with said printed circuit board and said housing secured together, said housing having means providing a plurality of coin chutes, means for receiving a plurality of light sources, and means for receiving a plurality of light sensors, said printed circuit board having a plurality of light sources and a plurality of light sensors thereon, said plurality of coin chutes having a respective plurality of exits, and said printed circuit board being located across said exits and having a plurality of slots therein respectively aligned with said exits, the light sources and sensors on said printed circuit board being on opposite sides of slots and received interiorly of said housing.

7. A coin switch as set forth in claim 1 and including a plurality of additional electrical components on said printed circuit board mounted exteriorly of said housing.

* * * * *